US006409653B1

(12) United States Patent
Koch et al.

(10) Patent No.: US 6,409,653 B1
(45) Date of Patent: Jun. 25, 2002

(54) TREATMENT UNIT FOR THE INTENSIVE CARE UNIT

(75) Inventors: Jochim Koch, Ratzeburg; Hans Ulrich Schüler, Lübeck; Wolf Dieter Schmidt, Bad Schwartau, all of (DE)

(73) Assignee: Dräger Medizintechnik GmbH (DE)

( * ) Notice: Subject to any disclaimer, the term of this patent is extended or adjusted under 35 U.S.C. 154(b) by 0 days.

(21) Appl. No.: 09/562,811

(22) Filed: May 1, 2000

(30) Foreign Application Priority Data

May 3, 1999 (DE) ..... 199 20 150
Mar. 4, 2000 (DE) ..... 100 10 720.6

(51) Int. Cl.[7] ..... A61G 11/00
(52) U.S. Cl. ..... 600/22
(58) Field of Search ..... 600/21–22, 549

(56) References Cited

U.S. PATENT DOCUMENTS 5,817,003 A * 10/1998 Moll et al. ..... 600/22

FOREIGN PATENT DOCUMENTS

DE 42 04 398 C1 6/1993

* cited by examiner

*Primary Examiner*—John P. Lacyk
(74) *Attorney, Agent, or Firm*—McGlew and Tuttle, PC

(57) ABSTRACT

A treatment unit with at least two heat sources and a lying surface (4) for a patient (2) is provided such that the ratio of the heat outputs of the heat sources in relation to one another can be set in a simple manner. A heater (5) with a first temperature control circuit (9) for setting a predetermined temperature on or in the environment of the patient (2) is provided along with a heater (3) at the lying surface (4). A second temperature control circuit (12) is provided for the lying surface heater (3). A logic circuit (15) is operatively connected between the first temperature control circuit (9) and the second temperature control circuit (12), which receives the temperature actual value or the temperature set point of the first control circuit (9) as a command variable and sends a tracking value as a lying surface temperature set point to the second temperature control circuit (12) via a temperature logic function (17).

12 Claims, 5 Drawing Sheets

TREATMENT UNIT FOR THE INTENSIVE CARE UNIT

FIELD OF THE INVENTION

The present invention pertains to a treatment unit with at least two heat sources and a lying surface for the patient.

BACKGROUND OF THE INVENTION

In open intensive care or even in incubators, heat is additionally supplied to the patient from the outside to compensate the heat balance. As long as only one heat source is used for this, the temperature can still be controlled in a relatively simple manner, because only the heat output of this heat source must be changed. However, as soon as a combination of different heat sources is present, the desired ratio of the heat outputs of the individual heat sources to one another must be determined.

DE 42 04 398 C1 discloses an incubator, in which a first control circuit for setting a certain air temperature is connected to a second control circuit for setting the humidity of the air via a logic circuit in such a way that the set point of the air humidity is automatically adjusted in case of a change in the set point of the air temperature. Two coupled control circuits are thus obtained for different parameters, which cooperate as master-slave control circuits during the conditioning of the ambient air.

SUMMARY AND OBJECTS OF THE INVENTION

The basic object of the present invention is to improve a treatment unit with two heat sources such that the ratio of the heat outputs of the heat sources can be set in relation to one another in a simple manner.

According to the invention, a treatment unit is provided with at least two heat sources and a lying surface for a patient. A first temperature control circuit is provided with a first heat source, a first temperature controller, a first temperature sensor detecting the body temperature of the patient, as well as a first set point setter for the body temperature. A second temperature control circuit is provided for setting the temperature of the lying surface, with a second heat source at the lying surface, a second temperature controller, and a second temperature sensor detecting the temperature of the lying surface. A logic circuit is provided operatively connected between the first temperature control circuit and the second temperature control circuit. The logic unit receives the actual value of the body temperature or the set point of the first control circuit, which is set on the set point setter, as a command variable. The logic unit sends a tracking value for the temperature of the lying surface to the second control circuit via a first logic function.

According to another aspect of the invention, a treatment unit with at least two heat sources and a lying surface for a patient is provided with first and second temperature control circuits. The first temperature control circuit sets the air temperature in the environment of the patient with a first heat source, a first temperature controller, a temperature sensor detecting the actual value of the air temperature within a hood surrounding the lying surface, as well as a first set point setter for the air temperature. The second temperature control circuit sets the temperature of the lying surface, containing a second heat source at the lying surface, a second temperature controller, and a second temperature sensor detecting the temperature of the lying surface. A logic circuit is provided operatively connected to the first temperature control circuit and the second temperature control circuit. The logic circuit receives the actual value of the air temperature or the set point of the first control circuit, which is set on the set point setter, as a command variable, and sends a tracking value for the temperature of the lying surface to the second control circuit via a second logic function.

According to another aspect of the invention, a treatment unit with at least two heat sources and a lying surface for a patient is provided with first and second temperature control circuits. The first temperature control circuit sets the air temperature in the environment of the patient with a first heat source, a first temperature controller, as well as a temperature sensor detecting the actual value of the air temperature within a hood surrounding the lying surface. The second temperature control circuit sets the temperature of the lying surface, with a second heat source at the lying surface, a second temperature controller, and a second temperature sensor detecting the temperature of the lying surface. A third temperature controller is connected to a first temperature sensor, which sends as the actual value a measured value proportional to the body temperature and receives a set point for the body temperature from a third set point setter, and which sends a preset set point for the air temperature to the first temperature controller. A logic circuit receives as the command variable the actual value of the air temperature or the preset set point of the third temperature controller, and sends a tracking value for the temperature of the lying surface to the second control circuit via a second logic function.

To compensate the heat balance of the patient, both an air heater (air temperature) and a lying surface heater are used in open care, but also in closed care in incubators.

If a radiant heater is operated together with a lying surface heater in an open care unit, it is necessary to clarify the question of how high the temperature of the lying surface heater shall be set. The patient without clothes, located on a lying surface, loses the most heat to the environment by radiant, convective and moisture losses. The radiant heater as the only heat source on this side of the body surface above the lying surface must therefore also assume most of the heat supply and compensate the heat losses to the environment to the extent that the patient's medium-term heat balance is compensated. The radiant heater is normally operated with a skin temperature control unit, which shall maintain the patient at a constant temperature, A temperature sensor is placed for this purpose on the skin of the patient, preferably on the patient's abdomen. The heat output of the radiant heater now depends on the deviation between the preset set point and the measured temperature of the skin surface. The heat output of the radiant heater can be changed relatively rapidly, because the thermal masses are very small. For example, the time constant of an infrared radiant heater is in the range of 3 minutes to 10 minutes.

Lying surface heaters normally have larger thermal masses and therefore a substantially longer time constant than radiant heaters. A lying surface heater comprises, e.g., an aluminum plate, to the underside of which a heating foil is attached. The aluminum plate ensures good heat distribution in the horizontal direction. A gel mattress, which offers a soft, flexible support, on the one hand, and ensures good heat conduction to the patient, on the other hand, lies on the aluminum plate. The time constant of such a heater is approximately between 30 minutes and 120 minutes. Because of its long time constant, the lying surface heater is not particularly suitable for rapidly changing the temperature of a patient in a closed control circuit. The principal task of the lying surface heater is therefore to minimize the heat losses on the underside of the patient.

As long as the lying surface has the same temperature as the core of the patient's body, no heat is transported to the patient. The lying surface heater prevents the conductive heat losses to the underside in this case. However, as soon as the patient cools off, the lying surface heater makes a positive contribution to thermal balancing. The heating of undercooled patients is an important use of the lying surface heater. The high temperature gradient of the cold body and the good heat conduction lead to rapid heating of the patient in this case.

The set point for the lying surface heater should be selected, in general, depending on the patient's body temperature and it should also be 37° C. in case of a normal body temperature of 37° C.

Provisions are made according to the present invention for providing a first temperature control circuit, which comprises a first temperature controller, a first temperature sensor detecting the patient's body temperature, a first heat source, and a first set point setter for the body temperature, in a treatment unit for the open care for stabilizing the temperature of the patient. A second temperature control circuit with a second heat source at the lying surface, with a second temperature sensor detecting the temperature of the lying surface, and with a second temperature controller receives the preset set point via a logic circuit from the first temperature control circuit. The logic circuit receives for this the actual value of the body temperature or the set point of the first control circuit, which is set on the first set point setter, as a command variable and sends a tracking value for the temperature of the lying surface to the second control circuit via a first logic function.

In closed care, the air within a hood is circulated with a fan and maintained at a predetermined set point. To set the air temperature, a first temperature control circuit is provided, in which the actual value of the air temperature is detected with a temperature sensor in the environment of the patient and is set to the set point with a first temperature controller.

To set the temperature of the lying surface, a second temperature control circuit is provided, which receives its preset set point via a second logic function from the first temperature control circuit.

The first temperature control circuit supplies for this the set point or the actual value of the air temperature to the logic circuit and the preset set point is generated from this via the second logic function. If a patient temperature, e.g., the body core temperature, is included in the control of the air temperature, an additional temperature controller in the form of a cascade control is advantageously arranged upstream of the first temperature controller, and the additional temperature controller receives the patient temperature as the actual value and forms a command variable by means of a set point of the patient temperature, and the command variable is passed on as a preset set point for the air temperature to the first temperature controller. Corresponding to the measured patient temperature, the preset set point set for the air temperature is increased or decreased by the additional temperature controller. By linking the first temperature control circuit with the second temperature control circuit for setting the temperature of the lying surface, optimal heat supply is obtained for the patient at the lowest possible heat loss.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
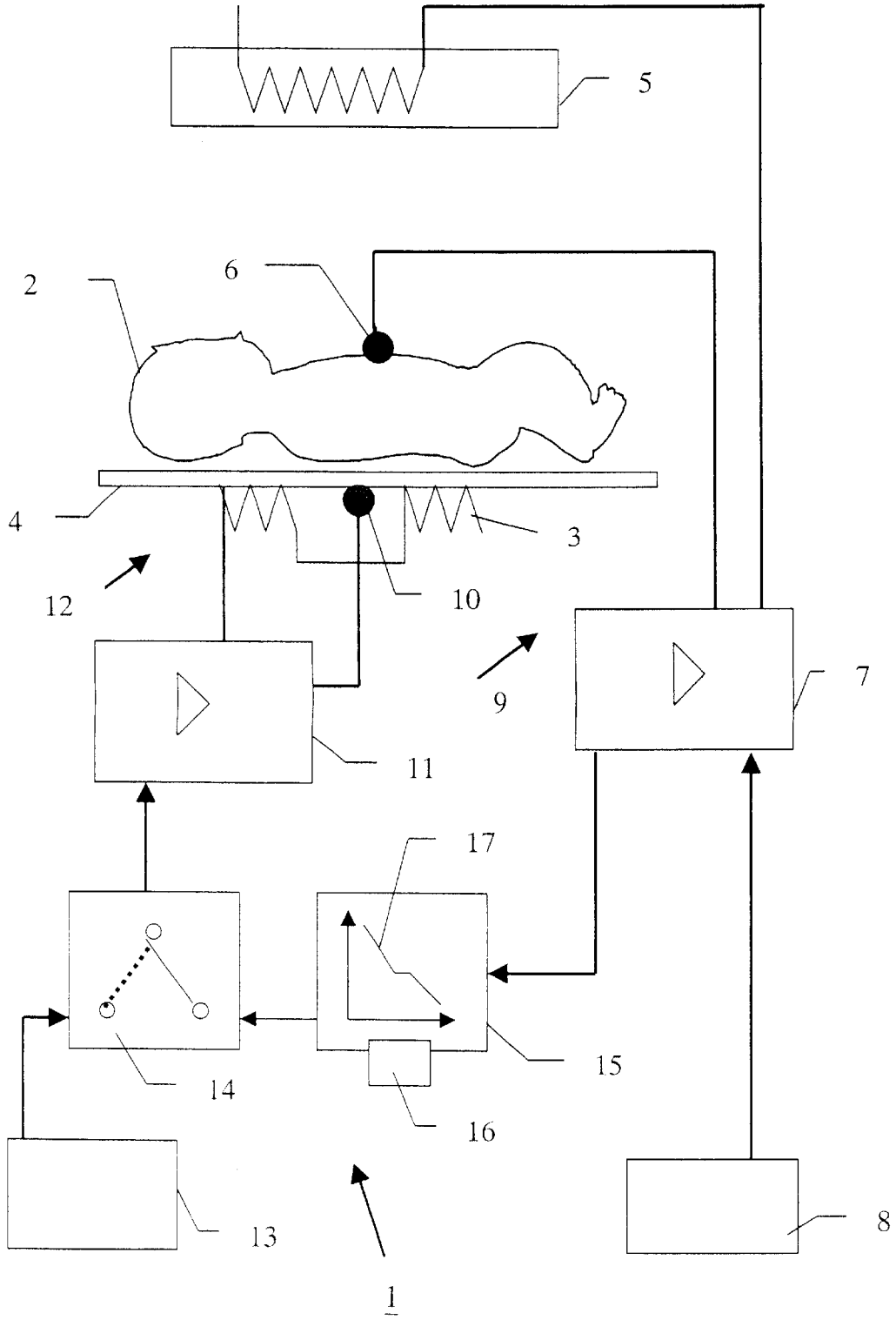
FIG. 1 is a schematic system view showing a first treatment unit for open care.

Referring to the drawings in particular, FIG. 1 schematically shows a first treatment unit 1 for open care. A first heat source 5 is directed toward a patient 2 positioned on a lying surface 4 equipped with a second heat source 3. The first heat source 5 is a radiant heater. The patient 2 is supplied with heat from the first heat source 5 in a radiant manner, on the one hand, and from the second heat source 3, on the other hand. The body temperature of the patient 2 is detected with a first temperature sensor 6 and is passed on as a patient temperature actual value to a first temperature controller 7, which sets the heat output of the first heat source 5 at a body temperature set point preselected with a first set point setter 8. The first heat source 5, the first temperature sensor 6, and the first temperature controller 7 together form a first temperature control circuit 9.

A second temperature sensor 10, which detects the temperature of the lying surface 4, and the second heat source 3 are connected to a second temperature controller 11 and together form a second temperature control circuit 12. The set point for the temperature of the lying surface can be preselected by means of a second set point setter 13, which is connected to the second temperature controller 11 via a changeover switch 14. A logic circuit 15 is located between the changeover switch 14 and the first temperature controller 7. In the switching position of the changeover switch 14 shown in FIG. 1, the first temperature control circuit 9 is connected to the second temperature control circuit 12 via the logic circuit 15 and the second set point setter 13 is out of operation. The logic circuit 15 receives the body temperature set point from the first temperature controller 7 and forms from this a tracking value for the temperature of the lying surface for the second temperature control circuit 12 via a first logic function 17 stored in a memory 16.

Figure 2:
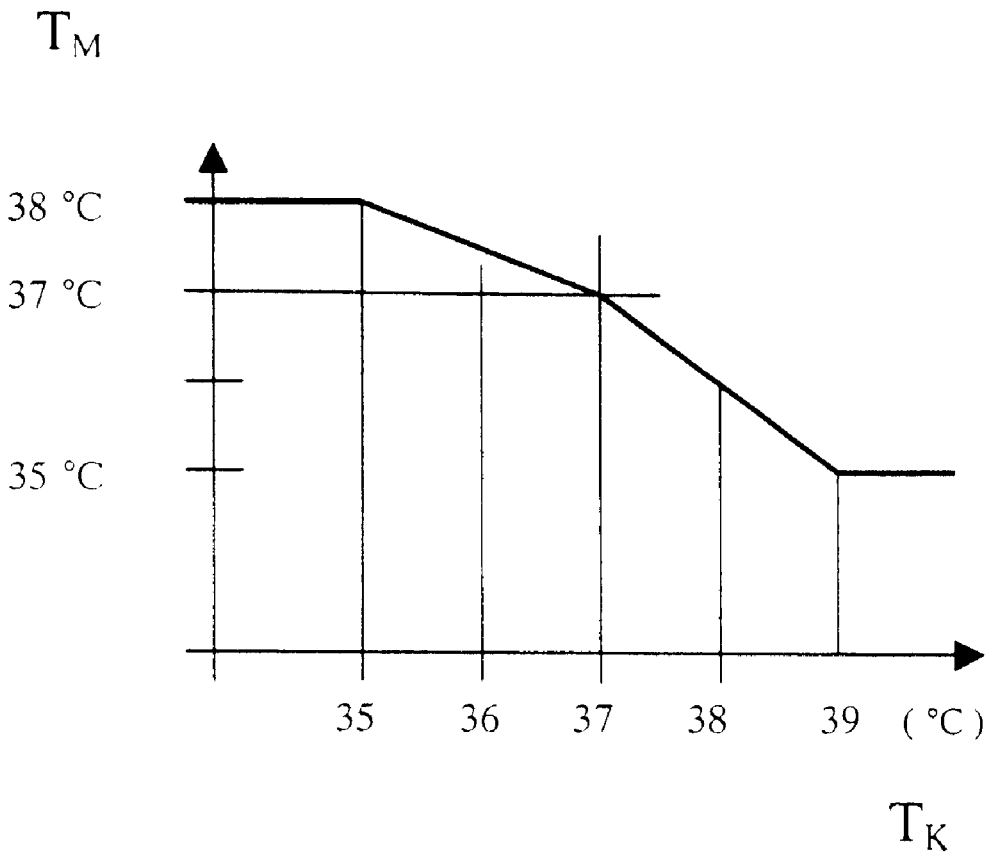
FIG. 2 is a diagram of a logic function with a relationship between the set point of the body core temperature and the set point of the lying surface temperature.

FIG. 2 schematically shows the logic function 17 between the body temperature set point $T_K$ and the set point of the lying surface $T_M$.

The first logic function 17 is designed such that a lying surface temperature $T_M$ range of 35° C. to 38° C. corresponds to a body temperature $T_K$ range of 35° C. to 39° C., and the value of $T_M$=38° C. belongs to $T_K$ lower than or equal to 35° C. and the value of $T_M$=37° C. belongs to $T_K$=37° C.

The set points are equal at a temperature of 37° C., so that heat is neither supplied nor removed. Any deviation of the body core temperature is adequately treated in a changed temperature for the lying surface. The effect is attenuated in time due to the longer time constant of the second heat source 3.

In the switching position of the changeover switch 14 schematically shown in FIG. 1, the second set point setter 13 is connected to the second temperature controller 11, so that the set points of the control circuits 9, 12 can be set independently from one another.

Figure 3:
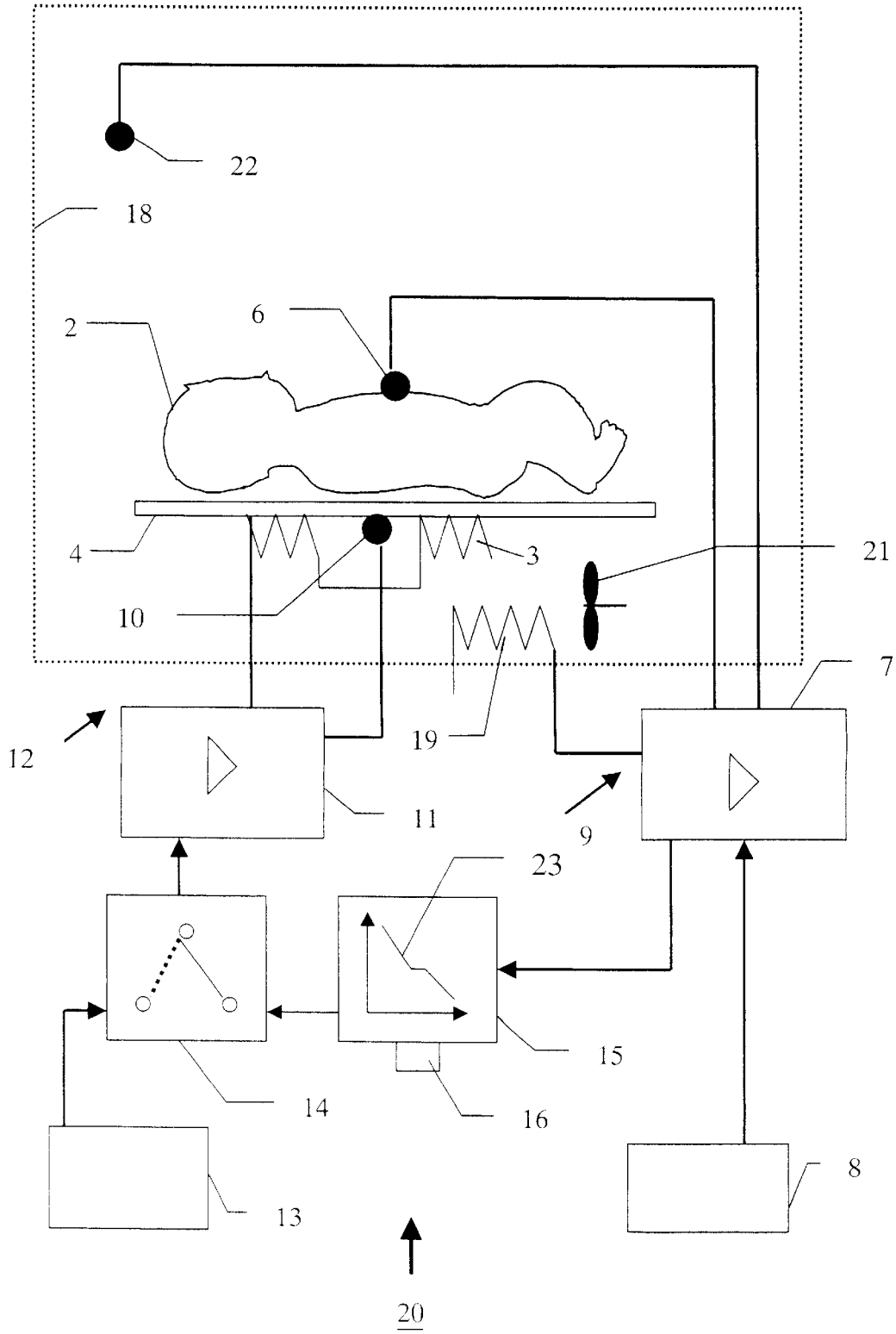
FIG. 3 is a schematic system view showing a second treatment unit for closed care.
Figure 4:
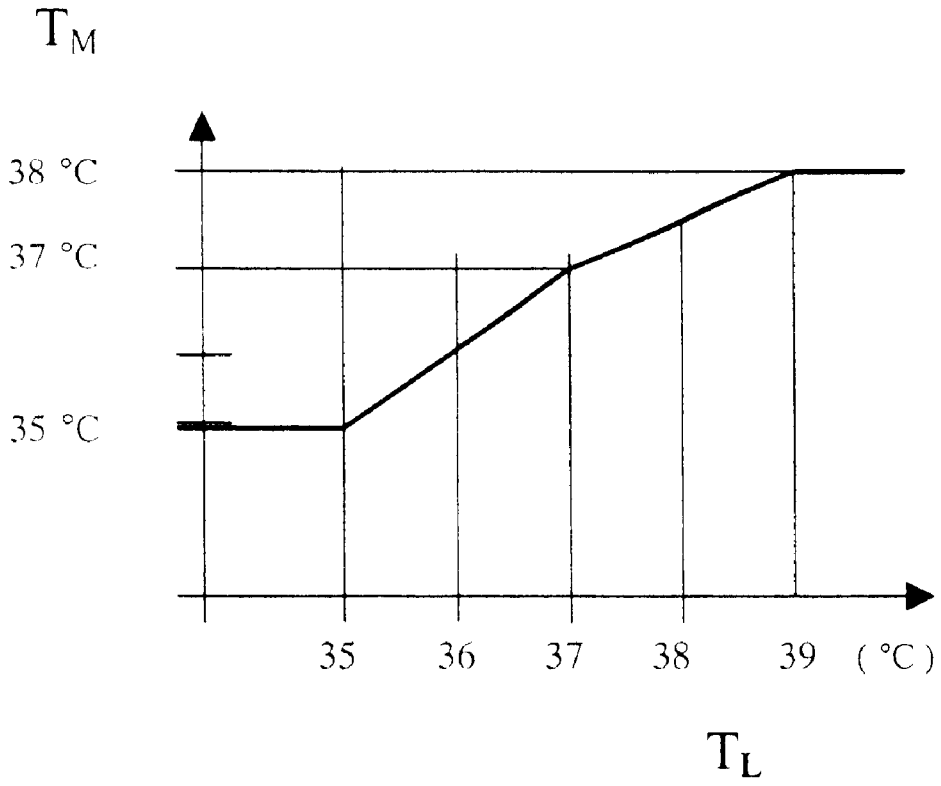
FIG. 4 is a diagram of a logic function with a relationship between the set point of the air temperature and the set point of the temperature of the lying surface.

A treatment unit 20 for closed care, which is shown in FIG. 3, differs from the first treatment unit 1 in FIG. 1 in that the lying surface 4 is arranged in a transparent hood 18 closed on all sides, and that a recirculating air heater with a first heat source 19 and with a fan 21 is present instead of the radiant heater. In addition to the first temperature sensor 6, a third temperature sensor 22 is arranged within the hood 18 for measuring the air temperature and is connected to the first temperature controller 7. Identical components are designated by the same reference numbers as in FIG. 1. An air temperature set point is set on the first set point setter 8. A second logic function 23 stored in the memory 16 specifies a relationship between the air temperature set point $T_L$ and the temperature set point $T_M$ for the lying surface 4, which is schematically illustrated in FIG. 4. The second logic function 23 is designed such that a lying surface $T_M$ temperature range of 35° C. to 38° C. corresponds to an air temperature $T_L$ range of 35° C. to 39° C., and the value of $T_M$=3 5C belongs to $T_L$=35° C. and the value of $T_M$=37° C. belongs to $T_L$=37° C.

In addition to the air temperature measured with the third temperature sensor 22, the body temperature of the patient 2 is optionally also detected with the first temperature sensor 6 in the second treatment unit 20 and is displayed for monitoring and control purposes, but it is not included in the control of the air temperature.

Figure 5:
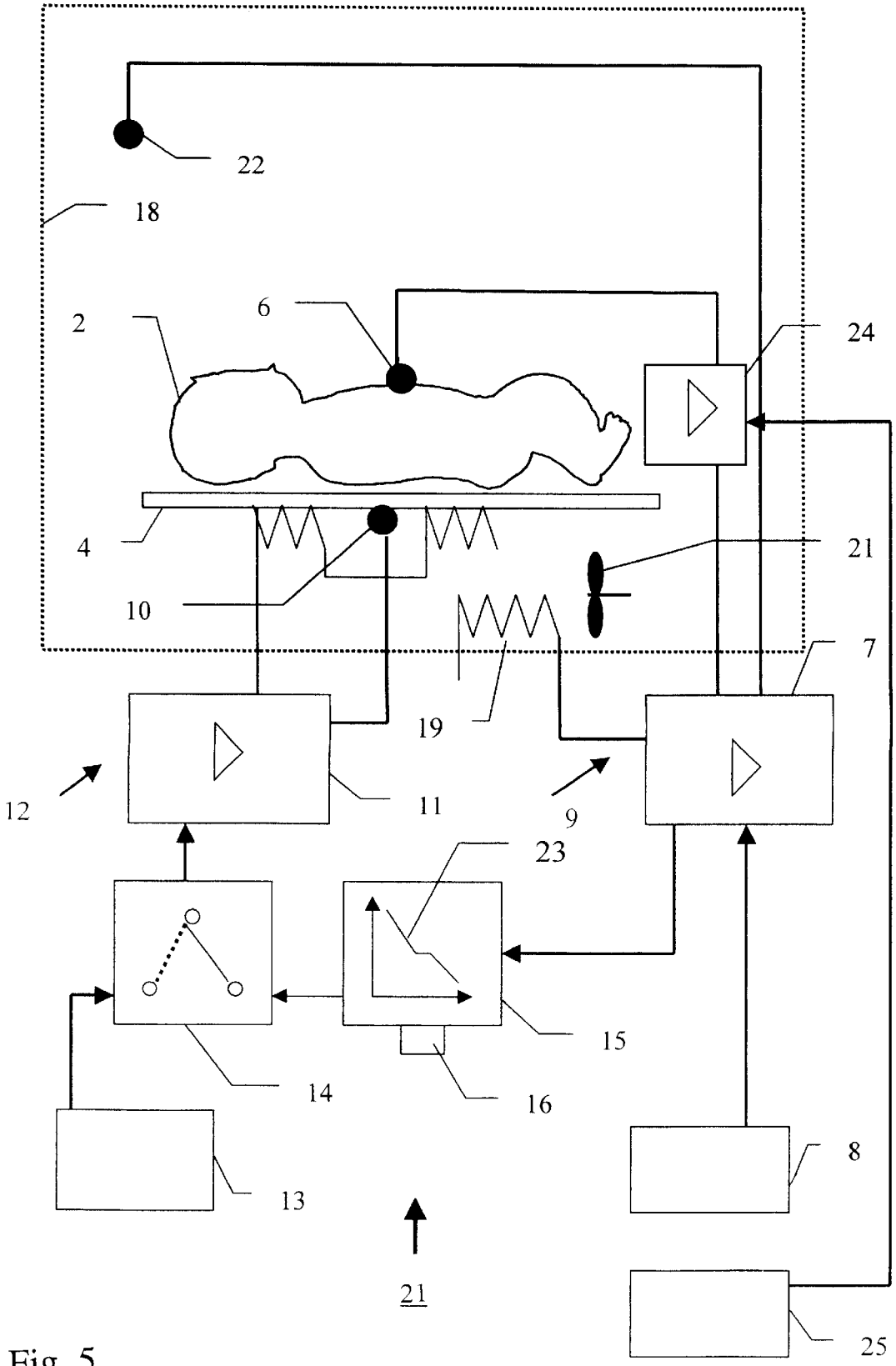
FIG. 5 is a schematic system view showing a third treatment unit for closed care.

The inclusion of the first temperature sensor 6 in the control of the air temperature is illustrated in FIG. 5.

The first temperature sensor 6 is connected via a third temperature controller 24 to the first temperature controller 7 in the form of a cascade circuit in the third treatment unit 21 shown in FIG. 5. The third temperature controller 24 receives preset values for the body temperature of the patient 2 via a third set point setter 25. To avoid conflicting settings, the first set point setter 8 for the air temperature and the third set point setter 25 for the body core temperature are mutually interlocked, so that either a set point can be set only on the first set point setter 8 for the air temperature or a set point for the body temperature can be set on the third set point setter 25. If a set point for the air temperature is preset on the first set point setter 8 and the third set point setter 25 for the body temperature is consequently blocked, the air temperature is measured with the third temperature sensor 22 and is further processed by the first temperature controller 7 as an actual value. Even though the first temperature sensor 6 does measure the body temperature of the patient, this value is not taken into account by the first temperature controller 7 during the setting of the air temperature. It in contrast, the third set point setter 25 for the body temperature is activated and the first set point setter 8 is consequently blocked, the third temperature controller 24 processes the actual value for the body temperature sent by the first temperature sensor 6 and the set point for the body temperature, which is preselected on the third set point setter 25 into a preset set point for the air temperature to be set on the first temperature controller 7. The actual value of the air temperature is continuously detected with the third temperature sensor 22. Corresponding to the body temperature measured with the first temperature sensor 6, the preset set point is changed on the first temperature controller 7 for the air temperature until the target variable set for the body temperature on the third set point setter 25 is reached. If, e.g., the body temperature is below the set point, the preset set point for the air temperature is increased by the third temperature sensor 24 and the preset set point for the air temperature is correspondingly reduced if the measured body temperature is above the set point set. The logic circuit 15 receives the actual value of the air temperature or the preset set point of the third temperature controller 24 as a command variable and sends a tracking value for the temperature of the lying surface to the second control circuit 12 via the second logic function 23.

Optimal temperature-stabilization of the patient 2 is achieved due to the change in the body temperature via the air temperature with the first temperature control circuit 9 in conjunction with the preset set point for the second control circuit 12 by means of the second logic function 23.

While specific embodiments of the invention have been shown and described in detail to illustrate the application of the principles of the invention, it will be understood that the invention may be embodied otherwise without departing from such principles.

What is claimed is:

1. A treatment unit, comprising:

a first heat source;

a second heat source;

a lying surface for a patient;

a first temperature control circuit with said first heat source, a first temperature controller, a first temperature sensor, detecting the body temperature of the patient, a first set point setter for the body temperature;

a second temperature control circuit for setting the temperature of the lying surface with said second heat source at the lying surface, a second temperature controller, and a second temperature sensor detecting the temperature of the lying surface;

a logic circuit which receives the actual value of the body temperature or the set point of the first control circuit set on the set point setter, as a command variable, and sends a tracking value for the temperature of the lying surface to the second control circuit via a first logic function.

2. The treatment unit in accordance with claim 1, wherein the first logic function is designed such that a lying surface temperature ($T_M$) range of 35° C. to 38° C. corresponds to a body temperature ($T_K$) range of 35° C. to 39° C., and the value of $T_M$=38° C. belongs to a $T_K$ lower than or equal to 35° C.

3. A treatment unit in accordance with claim 2, wherein value of $T_M$=37° C. is associated with $T_K$=37° C.

4. A treatment unit in accordance with claim 1, wherein said first heat source is a convective or radiant heater.

5. A treatment unit, comprising:

a first heat source;

a second heat source;

a lying surface for a patient;

a first temperature control circuit for setting the air temperature in the environment of the patient with said first heat source, a first temperature controller, a temperature sensor detecting the actual value of the air temperature within a hood surrounding the lying surface, as well as a first set point setter for the air temperature;

a second temperature control circuit for setting the temperature of the lying surface with said second heat source at said lying surface, a second temperature controller, and a second temperature sensor detecting the temperature of the lying surface;

a logic circuit which receives the actual value of the air temperature or the set point of the first control circuit, which is set on the set point setter, as a command variable, and sends a tracking value for the temperature of the lying surface to the second control circuit via a logic function.

6. A treatment unit in accordance with claim 5 wherein said logic function is designed such that a lying surface temperature $T_M$ range of 35° C. to 38° C. corresponds to an air temperature $T_L$ range of 35° C. to 39° C., and the value of $T_M$=35° C. belongs to $T_L$=35° C.

7. A treatment unit in accordance with claim 6, wherein value of $T_M$=37° C. belongs to $T_L$=37° C.

8. A treatment unit in accordance with claim 5, wherein said first heat source is a recirculating air heater with a fan.

9. A treatment unit, comprising:

a first heat source;

a second heat source;

a lying surface for a patient;

a first temperature control circuit for setting the air temperature in the environment of the patient with said first heat source, with said first heat source, a first temperature controller, as well as a temperature sensor detecting the actual value of the air temperature within a hood surrounding the lying surface;

a second temperature control circuit for setting the temperature of the lying surface, containing said second heat source at said lying surface, a second temperature controller, and a second temperature sensor detecting the temperature of the lying surface;

a third temperature controller, which is connected to a first temperature sensor, which sends as the actual value a measured value proportional to the body temperature and receives a set point for the body temperature from a third set point setter, and which sends a preset set point for the air temperature to said first temperature controller; and a logic circuit which receives as the command variable the actual value of the air temperature or the preset set point of said third temperature controller, and sends a tracking value for the temperature of the lying surface to said second control circuit via a logic function.

10. A treatment unit in accordance with claim 9 wherein said logic function is designed such that a lying surface temperature $T_M$ range of 35° C. to 38° C. corresponds to an air temperature $T_L$ range of 35° C. to 39° C., and the value of $T_M$=35° C. belongs to $T_L$=35° C.

11. A treatment unit in accordance with claim 10, wherein value of $T_M$=37° C. belongs to $T_L$=37° C.

12. A treatment unit in accordance with claim 9, wherein said first heat source is a recirculating air heater with a fan.

* * * * *